United States Patent [19]

Logan

[11] 4,272,327

[45] Jun. 9, 1981

[54] FORM AND LABEL COMBINATION

[76] Inventor: Emanuel L. Logan, 9406 Flower Ave., Silver Spring, Md. 20901

[21] Appl. No.: 45,994

[22] Filed: Jun. 6, 1979

[51] Int. Cl.[3] ..... B42D 15/00

[52] U.S. Cl. ..... 283/1 B; 283/21; 283/62; 229/73

[58] Field of Search ..... 40/2.2; 229/73, 921; 203/1 R, 1 A, 1 B, 18, 21, 66 R, 62

[56] References Cited

U.S. PATENT DOCUMENTS

| | | | |
|---|---|---|---|
| 892,675 | 7/1908 | Morrison | 283/1 B |
| 1,645,148 | 10/1927 | McCain | 229/73 |
| 2,321,184 | 6/1943 | Butterworth | 283/21 |
| 2,563,340 | 8/1951 | Kelly | 283/18 |
| 3,506,186 | 4/1970 | Von Clemm | 229/73 |
| 3,545,669 | 12/1970 | Kinkade | 229/73 |
| 3,693,869 | 9/1972 | Eaves Jr. | 229/73 |
| 3,822,492 | 7/1974 | Crawley | 40/2 |
| 4,029,341 | 6/1977 | Neill et al. | 283/21 X |

OTHER PUBLICATIONS

IRS form 1040A–with preprint label.

*Primary Examiner*—Paul A. Bell
*Attorney, Agent, or Firm*—Quaintance, Murphy & Richardson

[57] ABSTRACT

Attachment of an address and bar-code label to a form is encouraged by defining a label placement area on the form, which area is dark in color to discourage writing in the area. The area also includes words such as "PLACE LABEL HERE" in a light color to instruct the person filling out the form to place the label in the area. Preferably, the remaining portion of the form is filled with writing to discourage the person filling out the form from putting an address or the label in an area other than the area designed as the label placement area. Moreover, an envelope with a transparent window corresponding in location to the placement of the label on the form may be provided with the form and label.

4 Claims, 6 Drawing Figures

FORM AND LABEL COMBINATION

BACKGROUND OF THE INVENTION

1. Field of the Invention

This invention relates to business forms, and more particularly this invention relates to business forms which utilize adhesive labels.

2. Other Considerations and Prior Art

In recent years there has been an enormous increase in the number and types of forms which are generated by institutions such as government agencies, insurance companies and a myriad of other organizations. These forms are frequently sent to individuals who are expected to respond. One way of expediting processing of these forms is to identify the forms as they are returned by using labels containing coded information specifically pertaining to individuals. It is however frequently difficult to persuade people to attach their particular label to the form relating to them. People have a tendency to simply throw the label away and write in their address which must then be read visually by personnel in the organization mailing the form. If a large percentage of people could be persuaded to attach an address label to forms, the forms could be processed by machinery thus saving considerable labor and freeing organizations of the rather tedious task of visually processing returned forms.

A readily apparent need for such an approach is in tax form processing offices. Processing of tax forms is slowed considerably because each form is now manually handled and the label visibly studied during processing. This is a tedious, time-consuming, and expensive task which tends to disrupt communication between the tax payer and government by slowing down processing.

SUMMARY OF THE INVENTION

In view of the foregoing considerations, it is an object of the instant invention to provide a form and label arranged so that a party filling in the form is encouraged to utilize the label supplied with the form by the originator of the form.

In view of this object and other objects, the instant invention contemplates a form having a label attaching area designated thereupon, which area is of a nature to discourage hand addressing of the form. An instruction is inscribed in the area telling the party to place a label, which is separately supplied, in the area. The label may have a computer code such as "bar code" formed thereon which identifies the particular party filling out the form. Preferably, the form is organized so that the only space for an address is in the label area so as to further encourage the user to adhere the label to the label area.

The instant invention further contemplates utilizing an envelope in combination with the form wherein the envelope has a window through which the label is visible after the form is folded. Moreover, the instant invention contemplates constructing the form with a fold bias so that the person filling out the form is encouraged to fold the form with the label positioned for registration with the transparent window.

DESCRIPTION OF THE PREFERRRED EMBODIMENT

Figure 1:
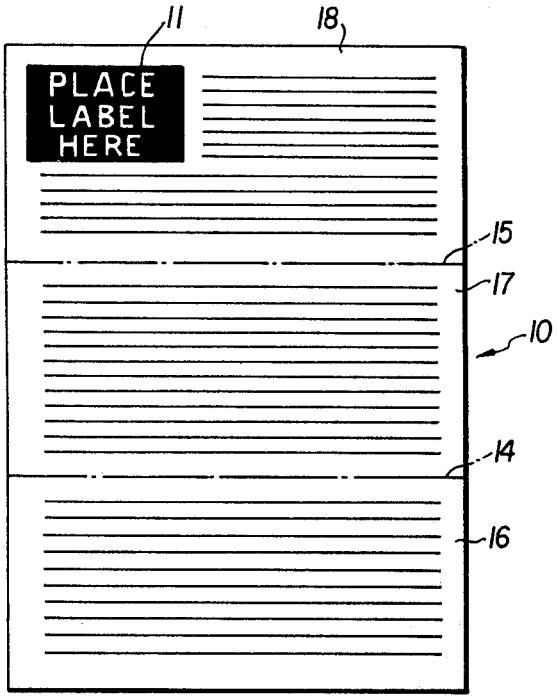
FIG. 1 is a front view showing a form according to the instant invention with a label space thereon.

Referring now to FIG. 1 there is shown a form 10, such as a tax form, having a label placement area 11 in the upper left hand corner thereof. The form 10 is completely filled with writing or is otherwise filled in areas other than the label placement areas so as to discourage the person filling out the form from writing an address in other areas.

Figure 2:
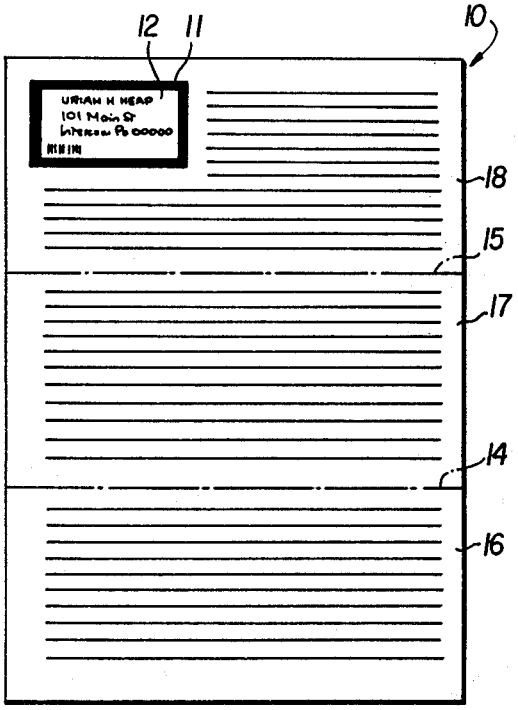
FIG. 2 is a front view of a label for use with the form shown in FIG. 1.

The label placement area is preferably black or another dark color and has associated therewith by being printed therein, preferably in white, an instruction such as "PLACE LABEL HERE". By making the label placement area 11 black or dark, it discourages the person or party filling out the form from writing in their address while the instruction, which is in white so as to be visible, tells the person or party to place a label in the label placement area. A label with an adhesive layer on one side such as the label 12 shown in FIG. 2 is supplied with the form 10 and may, for example, be initially adhered to information mailed along with the form 10. For example, if the form 10 is a tax form, then the label 12 may be attached to the booklet containing the tax form. If there are a plurality of forms 10 in the booklet, such as is, the practice with tax forms, then a plurality of labels can be attached to the booklet.

The label 10 has indicia thereupon which relate to the particular person or party filling out the form. For example, with tax forms, the label may include an individual's Social Security Number. Preferably, the number will be placed on the label in bar-code form by a bar code 13. In addition, other information relating to the person, the person's address, or some of other classification of the person may be included in the bar code 13.

Figure 4:
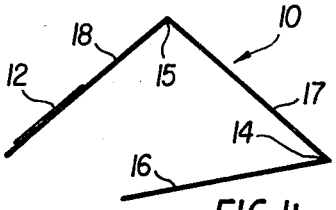
FIG. 4 is a side view showing the construction of the form of FIG. 1 wherein the form has a fold bias along creases in the form.
Figure 5:
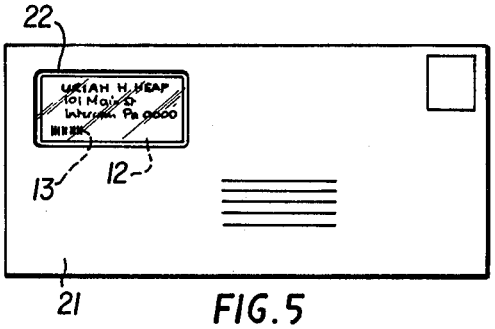
FIGS. 5 and 5*a* are views of envelopes with transparent windows through which labels are visible after the labels are properly adhered to the forms and the forms stuffed into the envelopes.

Before the person returns the form 10, the label 12 is adhered or otherwise attached to the label placement area 11. As is seen in FIG. 4, the form 10 has creases 14 and 15 which extend thereacross, dividing the form into three panels 16, 17 and 18. According to known techniques, the creases 14 and 15 have a built in bias which encourages people to fold panel 16 against panel 17 and panel 18 over panel 16. Since the label 12 is in the upper left hand corner of panel 18, it is exposed so that when the folded form 10 is placed in the envelope 21 of FIG. 5, the label will appear in a transparent window formed in the envelope 21.

When the stuffed envelope 21 arrives at its designation the bar code on the label 12 may be machine scanned according to known techniques and the envelope 21 identified accordingly. This identification can be used for any type of sorting procedure. When the envelope is opened and the form 10 removed, then the label 12 can be used to further process the form. This is especially helpful if there are a plurality of forms 10 in the envelope 21.

Figure 3:
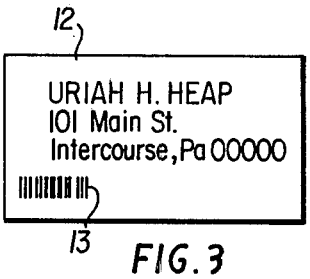
FIG. 3 is a front view showing the label in place on the form of FIG. 1.
Figure 5A:
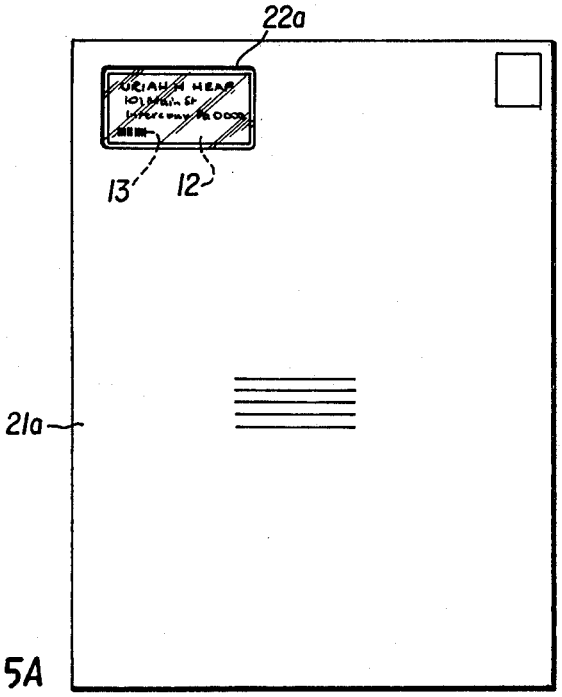

While a regular business size envelope 21 is preferred, it is also within the scope of this invention to utilize a flat letter envelope, such as the envelope 21*a* of FIG. 5*a*, corresponding in dimension to the form 10 in its unfolded state shown in FIGS. 1 and 3. The particular configuration of the envelope is, of course, an option of the organization originating the form.

The foregoing example is merely illustrative of the invention which is limited only by the following claims.

I claim:

1. In combination, a form and a separate label for attachment to the form wherein the form includes a label placement area thereon which is substantially black in color for discouraging writing in the area by making writing in blue or black ink hard to see and wherein printed matter substantially covers the remainder of the form; wherein the label placement area has a visible instruction within the borders thereof which is light in color in contrast to the label placement area which is substantially black in color, the instruction instructing one to place the label in the label placement area; and wherein the label includes code means for identifying a particular party to whom the form relates and an adhesive layer for attachment of the label to the label placement area.

2. The combination of claim 1 wherein the label placement area is positioned in the upper left hand corner of the form.

3. The combination of claim 2 wherein the form has transverse creases therein which are biased to encourage folding the form with the label exposed after the label is attached to the label placement area.

4. The combination of claims 1, 2, 3 further including in combination an envelope having a window in the upper left hand corner thereof with which the label is registered when the form is placed in the envelope.

* * * * *